US009644879B2

(12) United States Patent
Broadbent

(10) Patent No.: US 9,644,879 B2
(45) Date of Patent: May 9, 2017

(54) APPARATUS AND METHOD FOR SENSING ICE THICKNESS AND DETECTING FAILURE MODES OF AN ICE MAKER

(71) Applicant: True Manufacturing Company, Inc., O'Fallon, MO (US)

(72) Inventor: John Allen Broadbent, Denver, CO (US)

(73) Assignee: TRUE MANUFACTURING COMPANY, INC., O'Fallon, MO (US)

( * ) Notice: Subject to any disclaimer, the term of this patent is extended or adjusted under 35 U.S.C. 154(b) by 394 days.

(21) Appl. No.: 14/162,365

(22) Filed: Jan. 23, 2014

(65) Prior Publication Data

US 2014/0208781 A1 Jul. 31, 2014

Related U.S. Application Data

(60) Provisional application No. 61/758,080, filed on Jan. 29, 2013.

(51) Int. Cl.
*F25C 1/00* (2006.01)
*F25C 5/18* (2006.01)

(52) U.S. Cl.
CPC ..... *F25C 5/185* (2013.01); *F25C 2400/14* (2013.01); *F25C 2600/04* (2013.01); *F25C 2700/04* (2013.01)

(58) Field of Classification Search
CPC ..... F25C 1/12; F25C 5/10; F25C 2700/04
See application file for complete search history.

(56) References Cited

U.S. PATENT DOCUMENTS

| | | | | |
|---|---|---|---|---|
| 4,899,548 | A | 2/1990 | Bimijian | |
| 4,959,966 | A | 10/1990 | Dimijian | |
| 4,970,877 | A | 11/1990 | Dimijian | |
| 5,477,694 | A | 12/1995 | Black et al. | |
| 6,405,546 | B1 * | 6/2002 | Billman | F25C 1/12 62/135 |

(Continued)

FOREIGN PATENT DOCUMENTS

WO 2004083971 A2 9/2004

OTHER PUBLICATIONS

Patent Cooperation Treaty, International Search Report for PCT/US2014/013700, mailed Jul. 10, 2014, 2 pages Jul. 10, 2014.

(Continued)

*Primary Examiner* — Jonathan Bradford
(74) *Attorney, Agent, or Firm* — Bryan Cave LLP

(57) ABSTRACT

An ice maker includes a refrigeration system, a water system, and a control system. The control system includes an air fitting disposed in the sump of the water system, a pneumatic tube, and a controller including a processor and an air pressure sensor. The air fitting defines a chamber in which air may be trapped and includes openings through which water in the sump is in fluid communication with the air in the chamber. The pneumatic tube is in fluid communication with the air pressure sensor and the air fitting. The air pressure sensor is adapted to sense a pressure corresponding to a sump water level. The controller is adapted to control the operation of the refrigeration system and the operation of the water system based upon the sump water level and to detect one or more failure modes of the water system based upon the sump water level.

19 Claims, 9 Drawing Sheets

(56) References Cited

U.S. PATENT DOCUMENTS

| | | | | |
|---|---|---|---|---|
| 2002/0020177 | A1 | 2/2002 | Billman | |
| 2003/0145608 | A1 | 8/2003 | Billman | |
| 2006/0272830 | A1 | 12/2006 | Fima | |
| 2007/0157636 | A1* | 7/2007 | Billman | F25C 1/12 62/73 |
| 2008/0092567 | A1 | 4/2008 | Doberstein et al. | |
| 2012/0031126 | A1 | 2/2012 | Zhang et al. | |

OTHER PUBLICATIONS

European Patent Office, Supplemental European Search Report mailed Aug. 5, 2016, 7 pages Aug. 5, 2016.

* cited by examiner

APPARATUS AND METHOD FOR SENSING ICE THICKNESS AND DETECTING FAILURE MODES OF AN ICE MAKER

FIELD OF THE INVENTION

This invention relates generally to automatic ice making machines and, more particularly, to ice making machines comprising systems and employing methods which permit for more reliably and controllably determining when to initiate a harvest cycle and for detecting the occurrence of a failure mode.

BACKGROUND OF THE INVENTION

Ice making machines, or ice makers, that employ freeze plates which comprise lattice-type cube molds and have gravity water flow and ice harvest are well known and in extensive use. Such machines have received wide acceptance and are particularly desirable for commercial installations such as restaurants, bars, motels and various beverage retailers having a high and continuous demand for fresh ice.

In these ice makers, water is supplied at the top of a freeze plate which directs the water in a tortuous path toward a water pump. A portion of the supplied water collects on the freeze plate, freezes into ice and is identified as sufficiently frozen by suitable means whereupon the freeze plate is defrosted such that the ice is slightly melted and discharged therefrom into a bin. Typically, these ice machines can be classified according to the type of ice they make. One such type is a grid style ice maker which makes generally square ice cubes that form within individual grids of the freeze plate which then form into a continuous sheet of ice cubes as the thickness of the ice increases beyond that of the freeze plate. After harvesting, the sheet of ice cubes will break into individual cubes as they fall into the bin. Another type of ice maker is an individual ice cube maker which makes generally square ice cubes that form within individual grids of the freeze plate which do not form into a continuous sheet of ice cubes. Therefore, upon harvest individual ice cubes fall from the freeze plate and into the bin. Various embodiments of the invention can be adapted to either type of ice maker, and to others not identified, without departing from the scope of the invention. Accordingly, the freeze plate as described herein encompasses any number of types of molds for creating a continuous sheet of ice cubes, individual ice cubes, and/or cubes of different shapes. Control means are provided to control the operation of the ice maker to ensure a constant supply of ice.

It is important to determine when the ice has formed to a sufficient thickness such that it can be harvested. Harvesting too early yields small cubes of ice that may not harvest properly. Harvesting too late yields large chunks of ice that do not easily separate into smaller pieces or individual cubes. Typically, an ice thickness sensor detects the thickness of the ice forming on the freeze plate. When a desired thickness is reached, the sensor signals the ice maker to terminate the freeze cycle and begin a harvest cycle. In the harvest cycle, the refrigeration cycle is reversed and the freeze plate is heated to melt the formed ice cubes away from the freeze plate.

Different devices have been used over the years to determine the ice thickness and thus the appropriate harvest point. Most commercial cube ice machines sold in the United States utilize a hinged sensor located in front of the freeze plate and evaporator to detect the ice thickness in order to initiate harvesting of the ice cubes at the appropriate time. The hinged sensor may use an electrical continuity sensor or an acoustic sensor to directly measure the ice thickness. The hinged sensor approach has the advantage of directly measuring ice thickness as opposed to inferring the thickness from other measurements. This type of system is very common because it is relatively easy to mechanically adjust and provides a relatively accurate ice thickness measurement.

However, this approach has a number of drawbacks. Because the sensor is in the food zone, it must comply with NSF rules for potable water. Thus, the sensor must be made of suitable material and have suitable geometry for use in the food zone of an ice machine, as defined by NSF. Also, the sensor is exposed to the flowing water, so care must be taken to ensure that it will not be adversely affected by the water itself or the scale that may be left on the sensor by the water.

Because the sensor is placed in front of the evaporator assembly and the freeze plate, it must move out of the way when the ice is harvested so that the sensor does not get hit by the falling ice. Thus, the sensor is a moving part which could fail by not moving correctly. The thickness of the ice sensed is a function of how far the sensor is from the ice. Thus the sensor must be in exactly the right position or it will not work as desired. This distance is controlled by a set screw which must be manually adjusted and thus could be adjusted incorrectly or change over time. Additionally, the ice thickness cannot be adjusted electronically because the ice thickness is controlled by the position of the set screw or other mechanical means. Consequently, the ice thickness can only be adjusted mechanically.

In some cases the hinged sensor approach uses electrical conductivity whereby an electrical probe on the sensor is positioned closely adjacent the surface of the evaporator and freeze plate. When ice builds to a desired thickness the electrical probe comes in contact with the flow of water completing an electrical circuit which can trigger the harvest cycle. This method is subject to fouling of the sensor with minerals or other contaminants that would adhere to the sensor and prevent electrical conductivity necessary to signal ice thickness. Additionally, the sensors must be protected from contaminants that would provide an alternate conductivity path. This sensor must also be designed so that the sensor will detect the water even if the water has extremely low conductivity, as is the case with deionized or "DI" water.

U.S. patent application Ser. No. 13/368,814 entitled "System, Apparatus, and Method for Ice Detection" by Rosenlund et al. discloses an acoustic sensor for sensing the thickness of the formed ice. The application proposes an acoustic transmitter that transmits acoustic waves at certain frequencies and an acoustic sensor that senses the reflection of the transmitted waves. When the sensed, reflected waves reach a certain expected amplitude, the system determines that the ice has reached the desired thickness. This sensor is still subject to NSF food zone requirements, still must be moved out of the way during the harvest cycle, and is still subject to placement in the ice maker by mechanical means (e.g., a set screw). Therefore even with an acoustic sensor, the ice thickness can only be adjusted manually, not electronically. Similar to acoustic sensors, capacitive sensors may also be used but suffer from similar drawbacks.

Yet another system for measuring ice thickness is described in U.S. Pat. Nos. 6,405,546 and 6,705,090 each entitled "Ice Maker Control and Harvest Method" granted to Billman et al. The disclosures of each of these patents are incorporated herein by reference. A process disclosed by Billman et al. utilizes a pressure transducer to determine the height of water in the sump of the ice maker and can thus determine when the desired quantity of water is no longer in the sump and instead has been frozen into ice cubes on the freeze plate so that ice harvesting can be started. However, a shortcoming of the Billman et al. patents is that because Billman et al. do not measure ice thickness directly, Billman et al. can mistake water leaks in the system as the formation or non-formation of ice on the freeze plate. For example, if water is leaking from the water system of the ice maker to the environment, Billman et al. will presume the reduced water height is resulting from the formation of ice on the freeze plate rather than water leaking from the system. The systems and methods described by Billman et al. would be fooled by this leak, causing a harvest cycle to occur even though the ice cubes are not fully formed, resulting in undersized ice cubes.

If water is leaking from the water supply into the water system of the ice machine, oversized ice slabs will result because the controller of Billman et al. will incorrectly detect that the higher water level is the result of less freezing, not the result of additional water entering the system. These oversized slabs may be difficult to separate into small pieces of ice or individual cubes. In the case of a serious leakage of water from the water supply into the ice maker water system, the sensor of Billman et al. would continue to make ice long after the desired ice thickness has been reached and a major failure of the ice maker will result, which could include an uncontrolled water leakage into the ice machine's surroundings.

Therefore, there is a need in the art for an ice maker comprising an apparatus and incorporating a method for accurately detecting ice thickness in an ice maker where: the ice thickness sensor is not located in the food zone, the ice thickness sensor is not subjected to the impurities of the water supply, the ice thickness sensor is not a moving part that needs to be moved clear of falling ice during the ice harvest cycle, the ice thickness sensor is not required to be precisely mechanically located and adjusted, and the ice thickness sensor is electronically adjustable. Additionally, there is a need in the art for an ice maker comprising an apparatus and incorporating a method for detecting failure modes of components of the ice maker that can result in damage to the ice maker and the ice maker surroundings.

Four possible failure modes in an ice maker may include: (i) a failure of the water supply to the ice maker; ii) a failure of the ice maker's water inlet valve; iii) a failure of the ice maker's purge valve; and iv) a failure of the ice maker's water pump. For example, a failure of the water supply can be caused by a water supply valve (e.g., a building or facility water supply valve external to the ice machine) being turned off or a failure of the water inlet valve in the ice maker to open. This failure can result in the ice maker running out of water and no longer being able to manufacture ice. A failure of the ice maker's water inlet valve can, if the water inlet valve fails CLOSED, prevent the ice maker from getting water, subsequently preventing the ice maker from making ice. If the water inlet valve fails OPEN, too much water may be supplied to the ice maker, possibly causing a loss in ice making performance (because there is too much water to freeze) or a leak of water into the environment around the ice maker. A failure of the ice maker's purge valve may result in an excess of water impurities collecting in the water in the sump and may cause the ice to be cloudy and/or the ice maker to stop functioning due to mineral accumulation. A failure of the water pump prevents water from being circulated across the freeze plate of the ice maker and thus prevents the making of ice.

Therefore, there is a need in the art for an ice maker comprising an apparatus and incorporating a method for accurately detecting the level of water in the ice maker so that one or more of the following failure modes can be detected: a failure of the water supply, a failure of the water inlet valve, failure of the purge valve, and/or a failure of the water pump.

SUMMARY OF THE INVENTION

Briefly, therefore, one embodiment of the invention is directed to an ice maker, wherein the ice maker includes a refrigeration system comprising a compressor, a condenser, a thermal expansion valve, an evaporator assembly, a freeze plate thermally coupled to the evaporator assembly, and a hot gas valve. The ice maker further includes a water system comprising a water pump, a water distribution tube, a purge valve, a water inlet valve, and a sump located below the freeze plate adapted to hold water. The ice maker also includes a control system comprising an air fitting, a pneumatic tube and a controller. The air fitting is disposed in the sump and defines a chamber in which air may be trapped and the air fitting includes one or more openings through which water in the sump is in fluid communication with the air in the chamber. The pneumatic tube has a proximal end and a distal end, wherein the distal end is connected to and in fluid communication with the air fitting. The controller comprises a processor and an air pressure sensor. The proximal end of the pneumatic tube is connected to and in fluid communication with the air pressure sensor. The air pressure sensor is adapted to sense an air pressure from the water in the sump compressing the air in the chamber of the air fitting, wherein the sensed pressure corresponds to a water level in the sump. The controller is adapted to control the operation of the refrigeration system and the operation of the water system based upon the water level in the sump and to detect one or more failure modes of the water system based upon the water level in the sump.

Another embodiment of the invention is a method of controlling an ice maker wherein the ice maker includes a refrigeration system comprising a compressor, a condenser, a thermal expansion valve, an evaporator assembly, a freeze plate thermally coupled to the evaporator assembly, and a hot gas valve. The ice maker further includes a water system comprising a water pump, a water distribution tube, a purge valve, a water inlet valve, and a sump located below the freeze plate adapted to hold water. The ice maker also includes a control system comprising an air fitting, a pneumatic tube and a controller. The air fitting is disposed in the sump and defines a chamber in which air may be trapped and the air fitting includes one or more openings through which water in the sump is in fluid communication with the air in the chamber. The pneumatic tube has a proximal end and a distal end, wherein the distal end is connected to and in fluid communication with the air fitting. The controller comprises a processor and an air pressure sensor. The proximal end of the pneumatic tube is connected to and in fluid communication with the air pressure sensor. The air pressure sensor is adapted to sense an air pressure from the water in the sump compressing the air in the chamber of the air fitting, wherein the sensed pressure corresponds to a water level in the sump. The method of controlling the ice maker comprises measuring the water level in the sump during a sensible cooling cycle to determine if the water level is varying beyond an acceptable range and detecting a leak failure mode if the water level in sump varies beyond the acceptable range during the sensible cooling cycle.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Embodiments of the ice maker described herein comprise a controller and an air pressure sensor which permit the detection of the thickness of the formation of ice on a freeze plate in an ice maker. Additionally, the controller and air pressure sensor allow the controller to determine the amount of water that has been converted to ice and determine the appropriate time at which to initiate an ice harvest cycle. By monitoring the water level throughout the ice making cycle, the controller can also determine and control the thickness of the ice cubes produced, the amount of remaining ice making water purged each cycle, when to open and close the inlet water valve to maintain the proper levels of water in the ice maker, whether water is leaking into or out of the ice maker and whether or not the water pump or other components of the ice maker are functioning properly. Accordingly, the controller can detect one or more failure modes of the ice maker.

Figure 1:
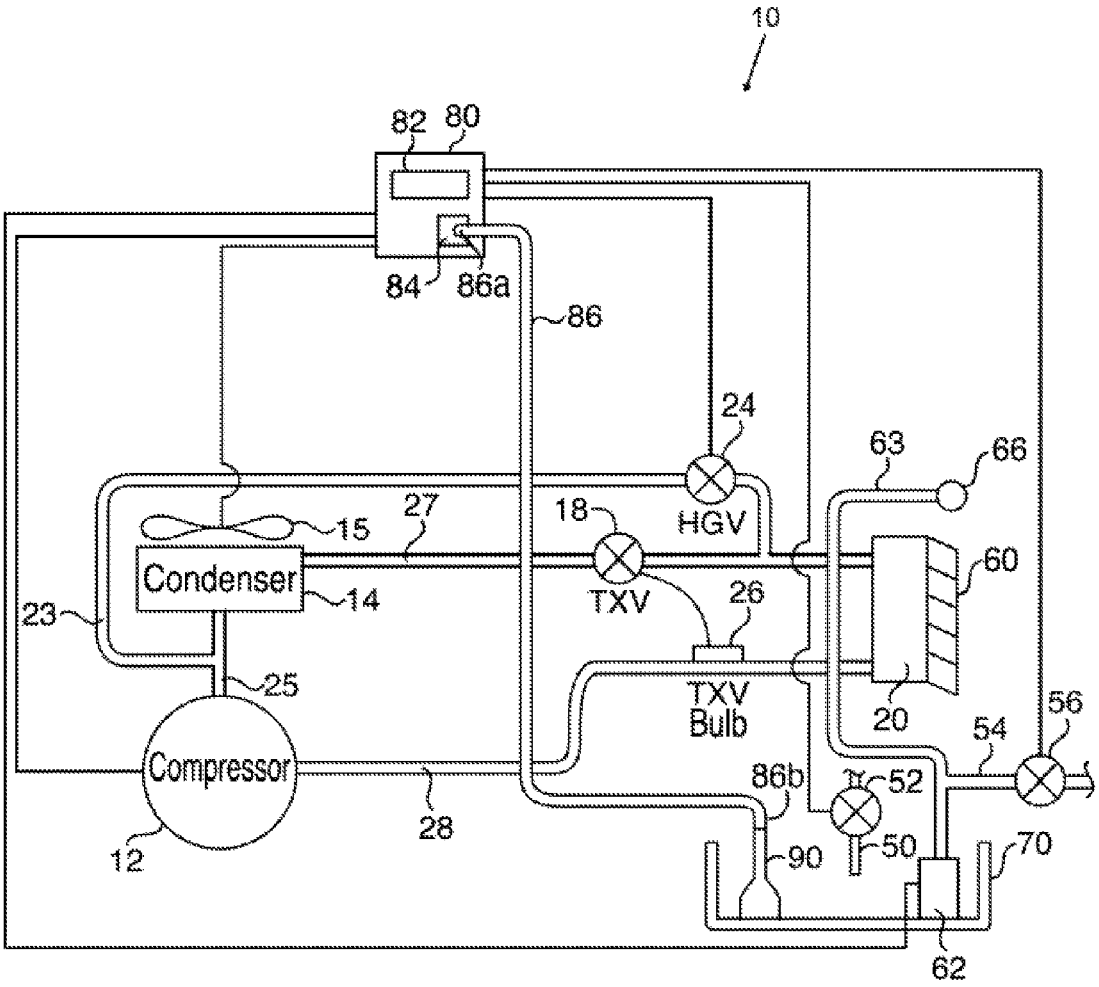
FIG. 1 is a schematic drawing of an ice maker having various components according to one embodiment of the invention.
Figure 4:
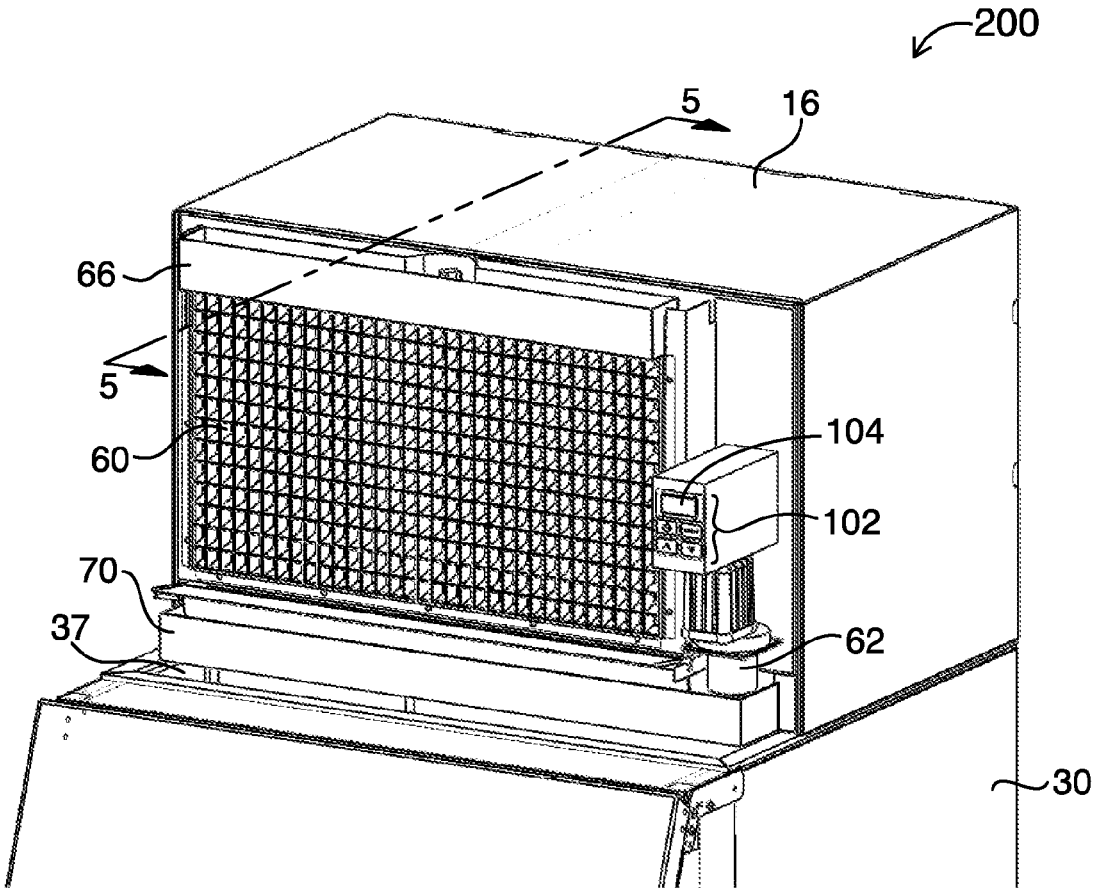
FIG. 4 is a right perspective view of an ice maker assembly with an ice maker disposed within a cabinet wherein the cabinet is disposed on an ice storage bin assembly according to one embodiment of the invention.

FIG. 1 illustrates certain principal components of one embodiment of ice maker 10 having a refrigeration system and ice making or water system. The refrigeration system of ice maker 10 may include compressor 12, condenser 14 for condensing compressed refrigerant vapor discharged from the compressor 12, thermal expansion device 18 for lowering the temperature and pressure of the refrigerant, evaporator assembly 20, freeze plate 60 thermally coupled to evaporator assembly 20, and hot gas valve 24. In certain embodiments, freeze plate 60 may contain a large number of pockets (usually in the form of a grid of cells) on its surface where water flowing over the surface can collect (see FIG. 4).

Thermal expansion device 18 may include, but is not limited to, a capillary tube, a thermostatic expansion valve or an electronic expansion valve. In certain embodiments, where thermal expansion device 18 is a thermostatic expansion valve or an electronic expansion valve, ice maker 10 may also include a temperature sensing bulb 26 placed at the outlet of the evaporator assembly 20 to control thermal expansion device 18. In other embodiments, where thermal expansion device 18 is an electronic expansion valve, ice maker 10 may also include a pressure sensor (not shown) placed at the outlet of the evaporator assembly 20 to control thermal expansion device 18 as is known in the art. In certain embodiments that utilize a gaseous cooling medium (e.g., air) to provide condenser cooling, a condenser fan 15 may be positioned to blow the gaseous cooling medium across condenser 14. As described more fully elsewhere herein, a form of refrigerant cycles through these components via a lines 23, 25, 27, 28.

The water system of ice maker 10 may include water pump 62, water line 63, water distribution manifold or tube 66, and sump 70 located below freeze plate 60 adapted to hold water. During operation of ice maker 10, as water is pumped from sump 70 by water pump 62 through water line 63 and out of distributor manifold or tube 66, the water impinges on freeze plate 60, flows over the pockets of freeze plate 60 and freezes into ice. Sump 70 may be positioned below freeze plate 60 to catch the water coming off of freeze plate 60 such that the water may be recirculated by water pump 62 (see FIGS. 4 and 5). In addition, hot gas valve 24 may be used to direct warm refrigerant from compressor 12 directly to evaporator assembly 20 to remove or harvest ice cubes from freeze plate 60 when the ice has reached the desired thickness.

Ice maker 10 may further include water supply line 50 and water inlet valve 52 disposed thereon for filling sump 70 with water from a water source (not shown), wherein some or all of the supplied water may be frozen into ice. Ice maker 10 may further include purge line 54 and purge valve 56 disposed thereon. Water and/or any contaminants remaining in sump 70 after ice has been formed may be purged via purge line 54 and purge valve 56. In various embodiments, purge line 54 may be in fluid communication with water line 63. Accordingly, water in sump 70 may be purged from sump 70 by opening purge valve 56 when water pump 62 is running.

Figure 5:
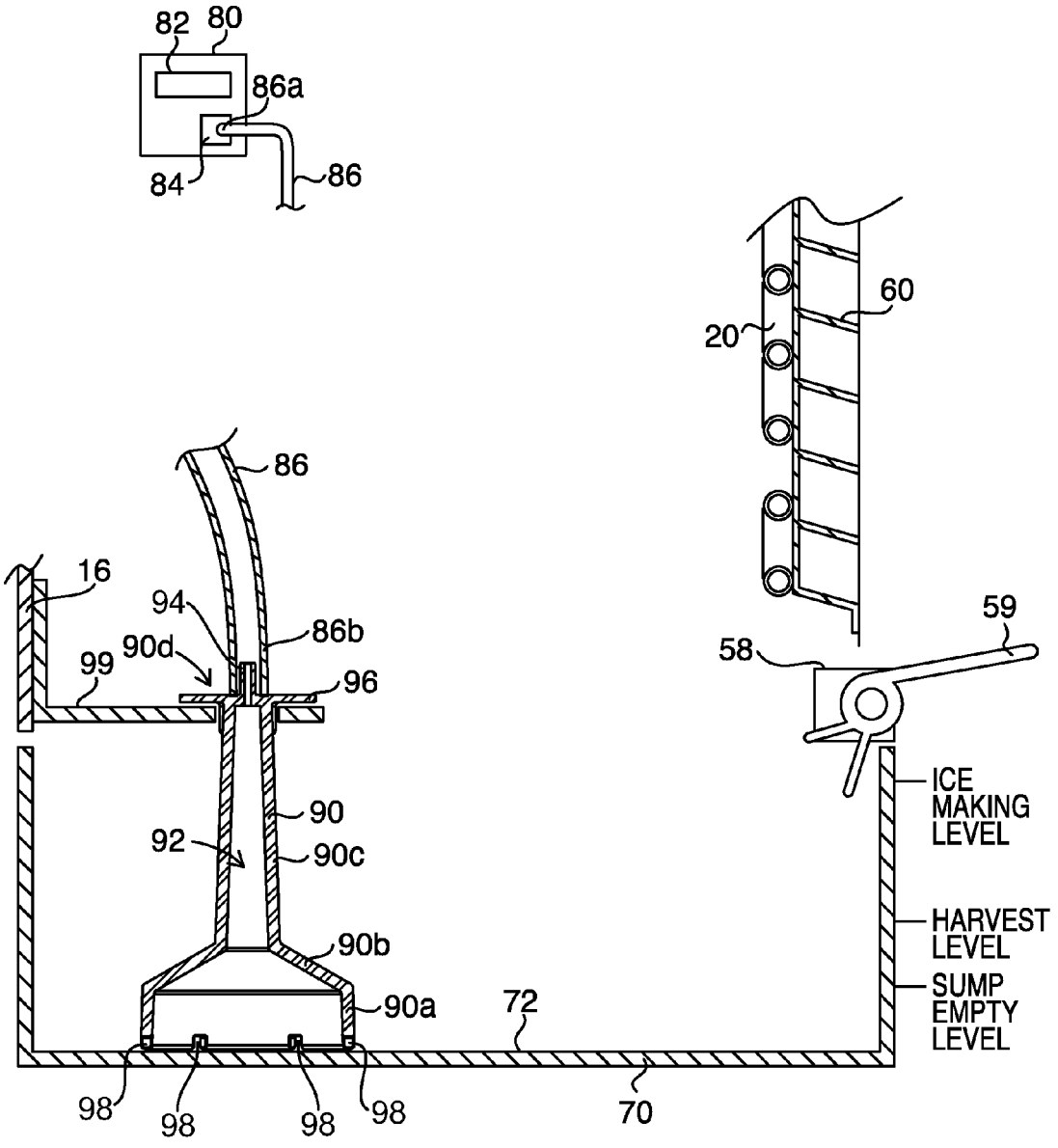
FIG. 5 is a section view of an ice maker according to one embodiment of the invention.

As illustrated in FIG. 5, ice maker 10 may also include harvest sensor 58 which may sense when door 59 is opened by ice as it is harvested from freeze plate 60. In certain embodiments, for example, as illustrated in FIG. 5, harvest sensor 58 may sense when door 59 is open or closed by sensing rotation of door 59. In other embodiments, for example, harvest sensor 58 may sense when door 59 is open or closed by whether door 59 contacts or is in proximity to harvest sensor 58. It will be understood that any type of harvest sensor which can sense whether door 59 is open or closed may be used without departing from the scope of the invention. Ice maker 10 may have other conventional components not described herein without departing from the scope of the invention.

Returning to FIG. 1, ice maker 10 may also include a control and water level measurement system having air fitting 90 disposed in sump 70, pneumatic tube 86 in fluid communication with air fitting 90, and controller 80. Controller 80 may be located remote from evaporator assembly 20 and sump 70. Controller 80 may include a processor 82 for controlling the operation of ice maker 10 and for determining if various components of the refrigeration and water systems of ice maker 10 have failed. Controller 80 may also include, or be coupled to, air pressure sensor 84, which may be used to detect the water pressure proximate bottom 72 (see FIG. 5) of sump 70 wherein the water pressure proximate bottom 72 of sump 70 can be correlated to the water level in sump 70. The water level in sump 70 may be correlated to the thickness of ice on freeze plate 60. Using the output from air pressure sensor 84, processor 82 can determine the water level in sump 70 throughout the cooling cycle. The use of air pressure sensor 84 also allows processor 82 to determine the appropriate time at which to initiate an ice harvest cycle, control the fill and purge functions, and to detect any failure modes of components of the water systems of ice maker 10 including, but not limited to, water supply failures, water inlet valve failures, water pump failures, purge failures, and water leaks.

In certain embodiments, air pressure sensor 84 may include a piezoresistive transducer comprising a monolithic silicon pressure sensor. The transducer may provide an analog signal to controller 80 with analog to digital (A/D) inputs. Air pressure sensor 84 may use a strain gauge to provide an output signal that is proportional to the applied pressure of water within sump 70. In certain embodiments, air pressure sensor 84 may be a low-cost, high-reliability air pressure transducer, such as part number MPXV5004 from Freescale Semiconductor of Austin, Tex. In other embodiments, controller 80 may also include, or be coupled to, any commercially available device for measuring water level in sump 70 in addition to or in replacement of air pressure sensor 84.

Processor 82 of controller 80 may include a processor-readable medium storing code representing instructions to cause processor 82 to perform a process. Processor 82 may be, for example, a commercially available microprocessor, an application-specific integrated circuit (ASIC) or a combination of ASICs, which are designed to achieve one or more specific functions, or enable one or more specific devices or applications. In yet another embodiment, controller 80 may be an analog or digital circuit, or a combination of multiple circuits. Controller 80 may also include one or more memory components (not shown) for storing data in a form retrievable by controller 80. Controller 80 can store data in or retrieve data from the one or more memory components. Controller 80 may also include a timer for measuring elapsed time. The timer may be implemented via hardware and/or software on or in controller 80 and/or processor 82 in any manner known in the art without departing from the scope of the invention.

Figure 2:
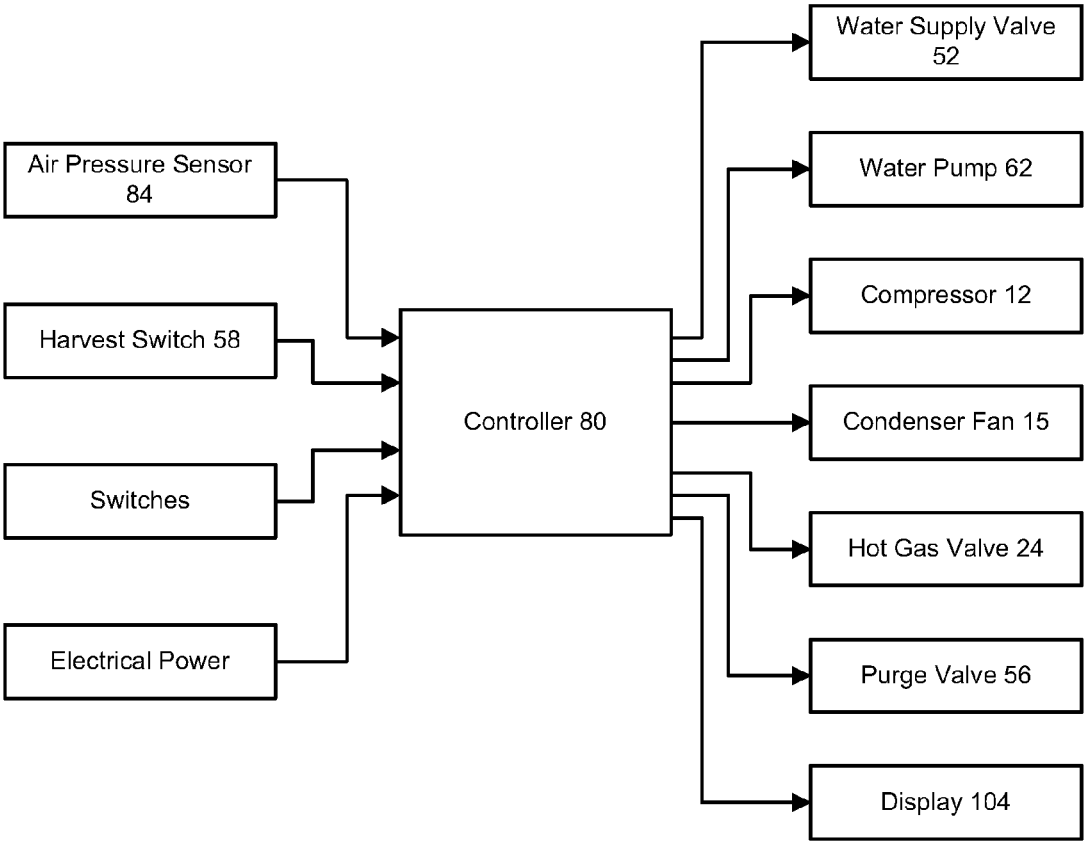
FIG. 2 is a schematic drawing of a controller for controlling the operation of the various components of an ice maker.

In various embodiments, in reference to FIGS. 1 and 2, controller 80 may also comprise input/output (I/O) components (not shown) to communicate with and/or control the various components of ice maker 10. In certain embodiments, for example controller 80 may receive inputs from an air pressure sensor 84, a harvest sensor 58 (see FIG. 5), an electrical power source (not shown), user control panel 102 (see FIG. 4), and/or a variety of sensors and/or switches including, but not limited to, pressure transducers, temperature sensors, acoustic sensors, etc. In various embodiments, based on those inputs for example, controller 80 may be able to control compressor 12, condenser fan 15, water pump 62, water inlet valve 52, purge valve 56, hot gas valve 24, and/or thermal expansion device 18. Controller 80 may also be able to control display 104 on user control panel 102 (see FIG. 4). Display 104 may be able to display messages, including error or failure messages, as reported and/or indicated by controller 80 to display 104. Display 104 may be any type and/or of display including, but not limited to, an LCD screen, one or more LEDs, etc. without departing from the scope of the invention. In certain embodiments, ice maker 10 may include an alarm (not shown) which can provide an audible alert that controller 80 has detected a failure mode. Alarm may include, but is not limited to, a speaker, a buzzer, a chime, a bell, and/or some other device capable of making a human-audible and/or non-human-audible sound. In certain embodiments, the alarm of ice maker 10 may emit a non-human-audible sound which may be detected by a telephone, smartphone, tablet computer, portable computer, and/or any portable device for diagnosing the failure mode. Display 104 and/or alarm may permit a person to determine if ice maker 10 is working or if a failure mode has been detected. Accordingly, in various embodiments, ice maker 10 can indicate that a failure mode has been detected.

According to one or more embodiments of the invention, the I/O component can include a variety of suitable communication interfaces. For example, the I/O component can include wired connections, such as standard serial ports, parallel ports, universal serial bus (USB) ports, S-video ports, local area network (LAN) ports, and small computer system interface (SCSI) ports. Additionally, the I/O component may include, for example, wireless connections, such as infrared ports, optical ports, Bluetooth® wireless ports, wireless LAN ports, or the like. In certain embodiments, controller 80 may be connected to a network (not shown), which may be any form of interconnecting network including an intranet, such as a local or wide area network, or an extranet, such as the World Wide Web or the Internet. The network can be physically implemented on a wireless or wired network, on leased or dedicated lines, including a virtual private network (VPN).

Referring now to FIG. 5, an embodiment of air fitting 90 and pneumatic tube of the control system is described in detail. In certain embodiments, air pressure sensor 84 may be connected to sump 70 by pneumatic tube 86 having a proximal end 86*a* and a distal end 86*b*. Proximal end 86*a* of pneumatic tube 86 is connected to air pressure sensor 84 and distal end 86*b* of pneumatic tube 86 is connected to and in fluid communication with air fitting 90. Air fitting 90 may be positioned in sump 70 and includes base portion 90*a*, first portion 90*b*, second portion 90*c*, and top portion 90*d* all in fluid communication with the water proximate bottom 72 of sump 70. Base portion 90*a*, first portion 90*b*, second portion 90*c*, and top portion 90*d* of air fitting 90 define a chamber 92 in which air may be trapped. One or more openings 98 surround the perimeter of base portion 90*a* allowing the water proximate bottom 72 of sump 70 to be in fluid communication with the air in chamber 92 of air fitting 90. As the water level in sump 70 increases, the pressure of the water proximate bottom 72 of sump 70 is communicated to the air in chamber 92 through the one or more openings 98 of air fitting 90. The air pressure inside chamber 92 increases and this pressure increase is communicated via air through pneumatic tube 86 to air pressure sensor 84. Controller 80 can thus determine the water level in sump 70. Additionally, as the water level in sump 70 decreases, the pressure in chamber 92 also decreases. This pressure decrease is communicated via air through pneumatic tube 86 to air pressure sensor 84. Controller 80 can thus determine the water level in the sump.

Base portion 90*a* of air fitting 90 may be substantially circular and may have a large diameter which may assist in reducing or eliminating capillary action of water inside chamber 92. First portion 90*b* may be substantially conical in shape and accordingly transition between the large diameter of base portion 90*a* to the smaller diameter of second portion 90*c*. Second portion 90*c* may taper from first portion 90*b* to top portion 90*d*. Disposed proximate top portion 90*d* may be a connector 94 to which distal end 896*b* of pneumatic tube 86 is connected. Connector 94 may be any type of pneumatic tubing connector known in the art, including, but not limited to, a barb, a nipple, etc. Air fitting 90 may also include flange 96 disposed proximate top portion 90*d* which may be affixed to a bracket 99 disposed on or in cabinet 16.

By placing air pressure sensor 84 in remotely located controller 80, air pressure sensor 84 is not located in the food zone. Due to such placement, air pressure sensor 84 may not be affected by the minerals or scale that the supply water can leave behind because air pressure sensor 84 does not come into contact with water. Additionally, because air pressure sensor 84 does not come into contact with water it may not be affected by the electrical properties of water and can therefore be used to determine ice thickness for de-ionized supply water and supply water with a heavy mineral content. Also, in certain embodiments, air pressure sensor 84 has no moving parts and therefore may not be susceptible to inconsistencies in its placement within ice maker 10 or changes over time as ice maker 10 ages. In certain embodiments, the position of air pressure sensor 84 and the position of air fitting 90 are not adjustable. Accordingly, in various embodiments, the ice thickness, the amount of water filled into sump 70, and the amount of water purged from sump 70 each cycle can be measured, controlled, and adjusted electronically.

Embodiments of this type of control and water level measurement system has additional advantages. First, as stated previously, a low-cost, high-reliability pressure transducer may be used in ice maker 10. Second, in various embodiments, because air pressure sensor 84 detects the water level in sump 70 of ice maker 10, air pressure sensor 84 and controller 80 may be used to initiate the harvest cycle and may also control the water fill and purge functions. That is, when the sump 70 of ice maker 10 is filling, controller 80 can control the timing of the closing of water inlet valve 52 when the water level in sump 70 reaches the desired water level as sensed by air pressure sensor 84. Third, in certain embodiments, controller 80 can open purge valve 56 during the harvest cycle. Accordingly, when purging the mineral-concentrated water that remains in sump 70 when the harvest cycle begins, air pressure sensor 84 can provide an indication to controller 80 of when the desired amount of water has been purged from sump 70. Thus embodiments of the control and water level measurement system can replace both the ice thickness sensor and the sump water level sensors found in typical ice makers.

Figure 3:
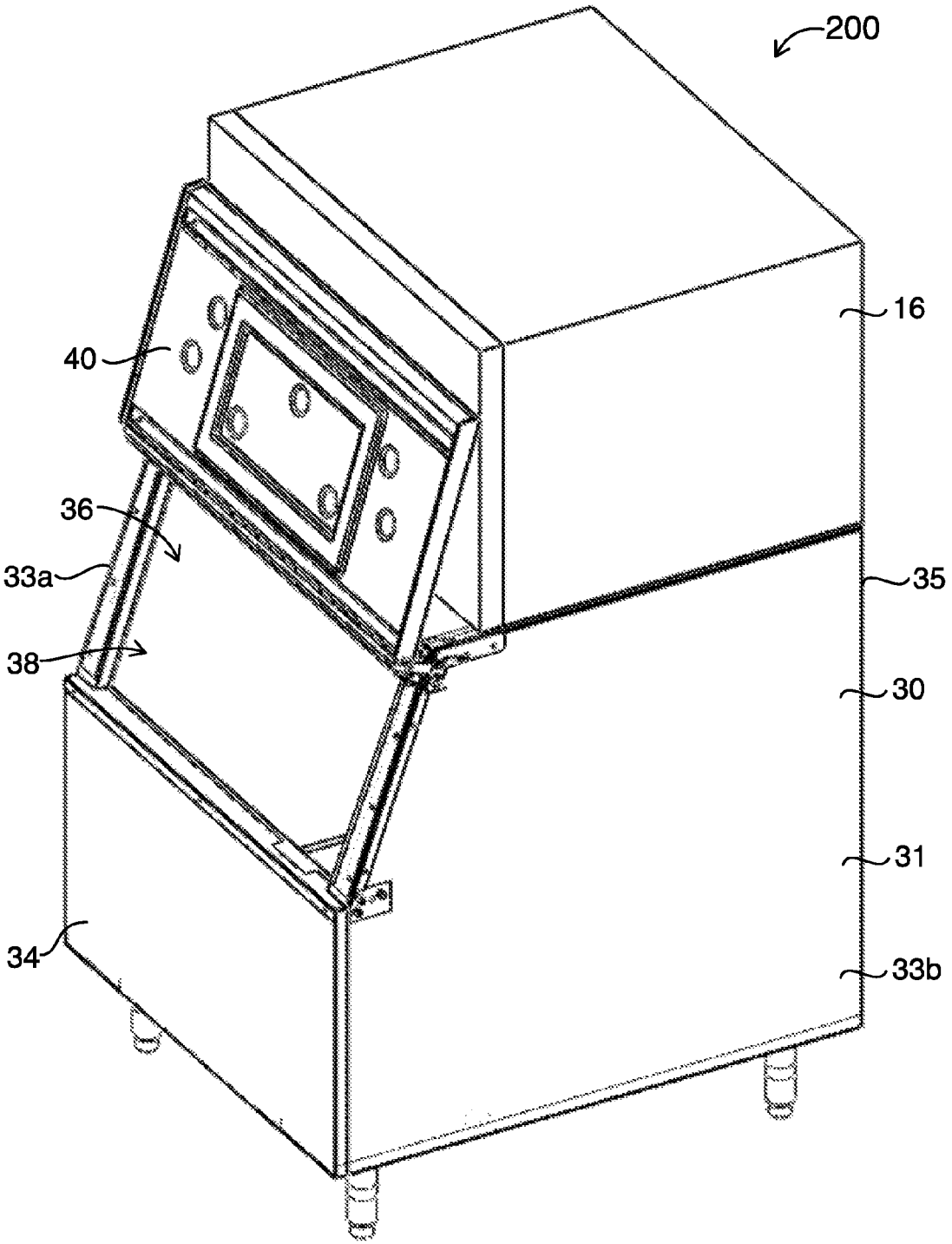
FIG. 3 is a right perspective view of an ice maker assembly with an ice maker disposed within a cabinet wherein the cabinet is disposed on an ice storage bin assembly according to one embodiment of the invention.

In many embodiments, as illustrated in FIG. 3, ice maker 10 may be disposed inside of a cabinet 16 which may be mounted on top of an ice storage bin assembly 30 forming an ice maker assembly 200. Cabinet 16 may be closed by suitable fixed and removable panels to provide temperature integrity and compartmental access, as will be understood by those in the art. Ice storage bin assembly 30 includes an ice storage bin 31 having an ice hole 37 (see FIG. 4) through which ice produced by ice maker 10 falls. The ice is then stored in cavity 36 until retrieved. Ice storage bin 31 further includes an opening 38 which provides access to the cavity 36 and the ice stored therein. Cavity 36, ice hole 37 and opening 38 are formed by a left wall 33*a*, a right wall 33*b*, a front wall 34, a back wall 35 and a bottom wall (not shown). The walls of ice storage bin 31 may be thermally insulated with various insulating materials including, but not limited to, fiberglass insulation or open- or closed-cell foam comprised, for example, of polystyrene or polyurethane, etc. in order to retard the melting of the ice stored in ice storage bin 31. A door 40 can be opened to provide access to cavity 36.

Having described each of the individual components of embodiments of ice maker 10, the manner in which the components interact and operate may now be described. During operation of ice maker 10 in a cooling cycle, comprising both a sensible cycle and a latent cycle, compressor 12 receives low-pressure, substantially gaseous refrigerant from evaporator assembly 20 through suction line 28, pressurizes the refrigerant, and discharges high-pressure, substantially gaseous refrigerant through discharge line 25 to condenser 14. In condenser 14, heat is removed from the refrigerant, causing the substantially gaseous refrigerant to condense into a substantially liquid refrigerant.

After exiting condenser 14, the high-pressure, substantially liquid refrigerant is routed through liquid line 27 to thermal expansion device 18, which reduces the pressure of the substantially liquid refrigerant for introduction into evaporator assembly 20. As the low-pressure expanded refrigerant is passed through tubing of evaporator assembly 20, the refrigerant absorbs heat from the tubes contained within evaporator assembly 20 and vaporizes as the refrigerant passes through the tubes. Low-pressure, substantially gaseous refrigerant is discharged from the outlet of evaporator assembly 20 through suction line 28, and is reintroduced into the inlet of compressor 12.

In certain embodiments, assuming that all of the components are working properly, at the start of the cooling cycle, water inlet valve 52 may be turned on to supply water to sump 70. After the desired level of water is supplied to sump 70, the water inlet valve 52 may be closed. Water pump 62 circulates the water from sump 70 to freeze plate 60 via water line 63 and distributor manifold or tube 66. Compressor 12 causes refrigerant to flow through the refrigeration system. The water that is supplied by water pump 62 then, during the sensible cooling cycle, begins to cool as it contacts freeze plate 60, returns to water sump 70 below freeze plate 60 and is recirculated by water pump 62 to freeze plate 60. Once the cooling cycle enters the latent cooling cycle, water flowing across freeze plate 60 starts forming ice cubes. After the ice cubes are formed, hot gas valve 24 is opened allowing warm, high-pressure gas from compressor 12 to flow through hot gas bypass line 23 to enter evaporator assembly 20, thereby harvesting the ice by warming freeze plate 60 to melt the formed ice to a degree such that the ice may be released from freeze plate 60 and falls through hole 37 (see FIG. 4) into ice storage bin 31 where the ice can be temporarily stored and later retrieved. Hot gas valve 24 is then closed and the cooling cycle can repeat.

To detect and protect against water leakage into or out of ice maker 10, controller 80 may monitor the water level (x) in sump 70 during the period in which the level of water in sump 70 is not expected to rise or fall. During the sensible cooling cycle, the water is cooled to the freezing point of the water. Stated otherwise, during the sensible cooling cycle the energy removed from the water contributes only to temperature change of the water and not to changing the state of the water from liquid to solid. During the latent cooling cycle, when the water begins reaching the freezing point, energy removed from the water begins to contribute to a change of state from liquid to solid.

Thus, during the sensible cycle, the water level (x) in sump 70 should not be changing as ice is not yet forming. If the water level (x) in sump 70 is varying during the sensible cooling cycle, this could indicate the occurrence of a failure mode of various components of the refrigeration and water systems of ice maker 10. In a typical ice maker, the sensible cooling cycle may last about 3 minutes. However, the length of the sensible cooling cycle is highly dependent upon the temperature of the water supplied to ice maker 10 and the ambient conditions. Accordingly, warmer water supplied in warmer climates takes longer to cool to its freezing point. Thus, in certain conditions, the sensible cooling cycle may last about 15 minutes or longer. Thus any increase or decrease in the water level (x) in sump 70 that occurs during the sensible cooling cycle of each cooling cycle, beyond an acceptable range of water level (x) due to water turbulence or some other transient event, may be due to a leak. Accordingly, an unacceptable change of the water level in sump 70 may result in controller 80 shutting ice maker 10 off. Alternatively or additionally, display 104 and/or the alarm may indicate that such a failure mode has been detected. For example, the indication may be a message, an indicator light, and/or a sound specific to the detected failure mode. In yet another embodiment, controller 80 may, upon the detection of a leak, determine if the leak is within an acceptable range and may cause an indication to be displayed on display 104 and/or played on the alarm that a leak has been detected, but continue to operate to make ice.

In various embodiments, controller 80 may continue to monitor the water level (x) in sump 70 for a period of time after ice maker 10 has stopped operation as a result of a detected leak. If the water level (x) in sump 70 remains constant during this period of time, controller 80 may restart the cooling cycle of ice maker 10. In this manner, controller 80 may restart ice maker 10 if the sensed water level variation that caused the shutdown was due to a transient event (e.g., a splashing in sump 70 caused by a person or other external factor).

In a similar manner, various embodiments of ice maker 10 can determine the ability of ice maker 10 to refill sump 70 with water, thus indicating whether water inlet valve 52 is supplying the desired amount of water for making ice. Specifically, if during the refilling portion of the cooling cycle, which occurs after the ice has released from the freeze plate and the water pump has turned back ON, the water level (x) in sump 70 does not increase, then controller 80 can determine that the supply of water to ice maker 10 has failed. This failure mode could be the result of a failure of the water supply or a failure of water inlet valve 52. In certain embodiments, display 104 and/or the alarm may indicate that such a failure mode has been detected. For example, the indication may be a message, an indicator light, and/or a sound specific to the detected failure mode. Controller 80 may optionally shut off ice maker 10. Likewise, various embodiments of ice maker 10 can detect if water inlet valve 52 has failed in the OPEN position. This may be detected by controller 80 if the water level (x) in sump 70 continues to rise after controller 80 has attempted to CLOSE water inlet valve 52. In certain embodiments, display 104 and/or the alarm may indicate that such a failure mode has been detected. For example, the indication may be a message, an indicator light, and/or a sound specific to the detected failure mode. Controller 80 may optionally shut off ice maker 10.

In normal operating conditions, when water pump 62 is turned ON, the water level (x) in sump 70 will drop as water is removed from sump 70 by water pump 62 and moved through water line 63 and across freeze plate 60 of ice maker 10. Thus, by monitoring the water level (x) when water pump 62 is turned ON, it is possible to determine if water pump 62 is functioning properly. If the water level (x) does not drop during the several seconds following water pump 62 being turned on, then controller 80 may detect a failure mode of water pump 62 and can take the appropriate actions. In certain embodiments, display 104 and/or the alarm may indicate that such a failure mode has been detected. For example, the indication may be a message, an indicator light, and/or a sound specific to the detected failure mode. Controller 80 may optionally shut off ice maker 10.

Figure 6A:
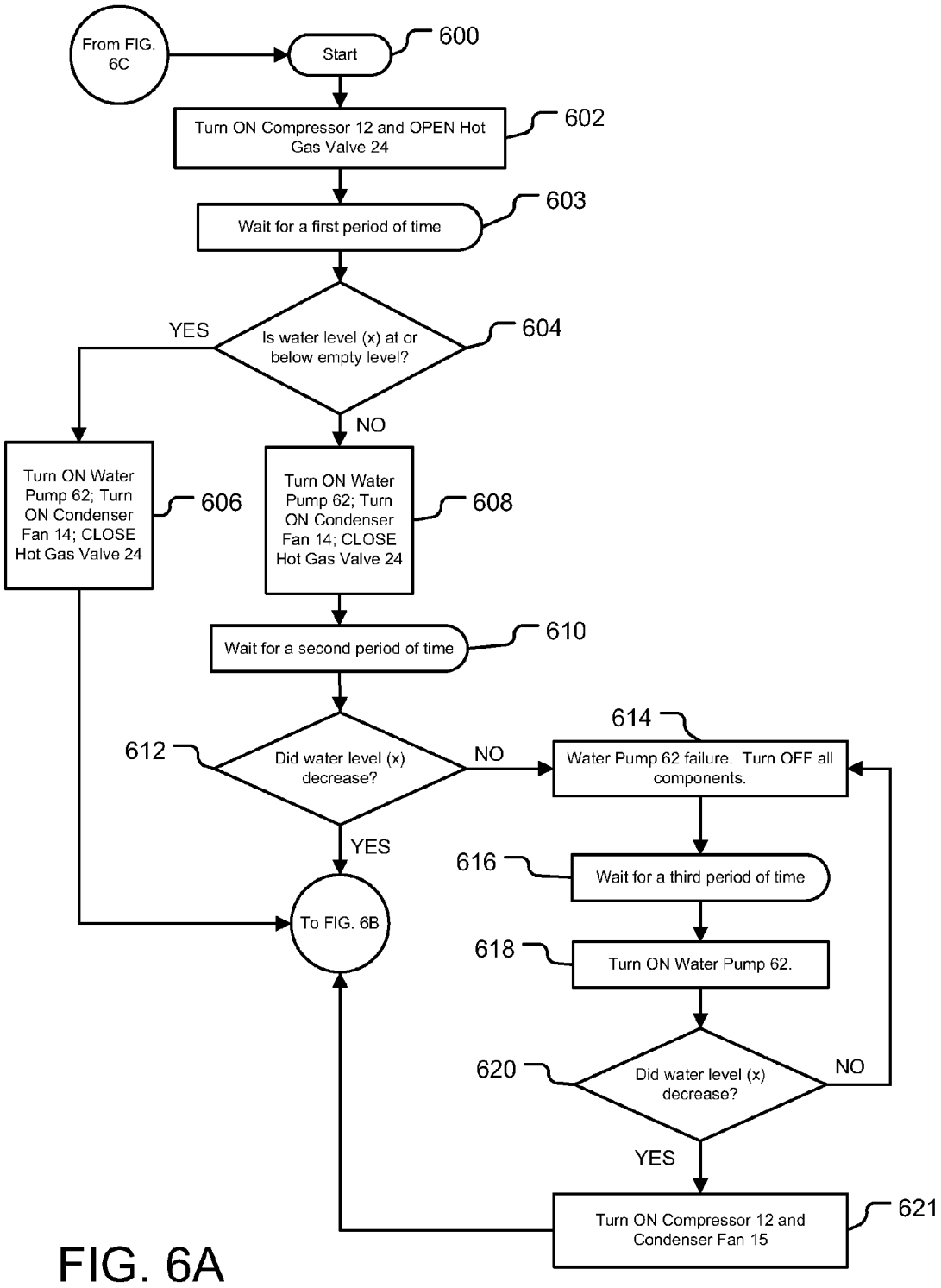
FIG. 6A is flow chart describing the operation of an ice maker according to one embodiment of the invention.

Referring now to FIGS. 6A-6D, a method of operation of certain embodiments of ice maker 10 is described in detail. In FIG. 6A, at step 600 the method starts and at step 602, controller 80 turns ON compressor 12 and OPENS hot gas valve 24 to begin a harvest cycle. While controller 80 waits for a first period of time at step 603, compressor 12 remains ON and hot gas valve 24 remains OPEN so that any ice formed on freeze plate 60 can be harvested. In certain embodiments, for example, the first period of time may be from about 30 seconds to about 5 minutes (e.g., about 30 seconds, about 45 seconds, about 1 minute, about 1.5 minutes, about 2 minutes, about 2.5 minutes, about 3 minutes, about 3.5 minutes, about 4 minutes, about 4.5 minutes, about 5 minutes). After the first period of time has elapsed, the harvest cycle is complete.

At step 604, controller 80 via air pressure sensor 84 measures the water level (x) in sump 70 to determine whether the water level (x) is at or below the empty level. If the water level (x) is at or below the empty level, the water pump test at step 612 will not work so the method moves to step 606. At step 606, controller 80 turns ON water pump 62, turns ON condenser fan 15, and CLOSES hot gas valve 24, then moves to step 622 on FIG. 6B. If the water level (x) in sump 70 is above the empty level, then controller 80 turns ON water pump 62, turns ON condenser fan 15, and CLOSES hot gas valve 24 at step 608. Controller 80 then waits a second period of time at step 610 to give water pump 62 enough time to remove some water from sump 70. In certain embodiments, for example, the second period of time may be from about zero (0) seconds to about 15 seconds (e.g., about zero (0) seconds, about 5 seconds, about 10 seconds, about 15 seconds). In either case, whether the water level (x) in sump 70 is at the empty level or not, water pump 62 may be turned ON prior to hot gas valve 24 closing or water pump 62 may be turned ON and hot gas valve 24 may be CLOSED simultaneously. Thus water begins flowing over freeze plate 60 prior to and/or at the same time that the refrigeration system begins to cool freeze plate 60.

At step 612 controller 80 determines whether the water level (x) in sump 70 has decreased beyond a desired range. In certain embodiments, the desired range may be from about +/−1 percent of the measured water level (x) to about +/−25 percent of the measured water level (x). In one embodiment, for example, the desired range may be about +/−1 percent of the measured water level. In another embodiment, for example, the desired range may be about +/−5 percent of the measured water level (x). In yet another embodiment, for example, the desired range may be about +/−10 percent of the measured water level (x). In yet another embodiment, for example, the desired range may be about +/−15 percent of the measured water level (x). In yet another embodiment, for example, the desired range may be about +/−20 percent of the measured water level (x). In yet another embodiment, for example, the desired range may be about +/−25 percent of the measured water level (x). If the water level (x) did decrease beyond the desired range, indicating that water pump 62 is functioning, the method moves to step 622 on FIG. 6B. If the water level (x) did not decrease beyond the desired range then water pump 62 has most likely failed; accordingly, at step 614 controller 80 turns OFF all components of ice maker 10. At step 616, controller 80 waits for a third period of time. In certain embodiments, for example, the third period of time may be from about 10 seconds to about 1.5 minutes (e.g., about 10 seconds, about 20 seconds, about 30 seconds, about 40 seconds, about 50 seconds, about 1 minute, about 1.5 minutes).

After the third period of time has elapsed, controller 80 turns ON water pump 62 at step 618. Then at step 620, controller 80 again determines whether the water level (x) in sump 70 has beyond a desired range. If the water level (x) did not decrease beyond the desired range, the method returns to step 614 and controller 80 turns OFF all components. Optionally, controller 80 may be able to log, report and/or indicate that water pump 62 has failed. In certain embodiments, display 104 and/or the alarm may indicate that such a failure mode has been detected. For example, the indication may be a message, an indicator light, and/or a sound specific to the detected failure mode. By delaying for a period of time, controller 80 can wait for any turbulent and/or transient movement of water in sump 70 to cease and can check to ensure the proper operation of water pump 62. If at step 620 the water level (x) in sump 70 did decrease beyond the desired range, controller 80 turns ON compressor 12, turns ON condenser fan 15 at step 621 and proceeds to step 622 on FIG. 6B.

Figure 6B:
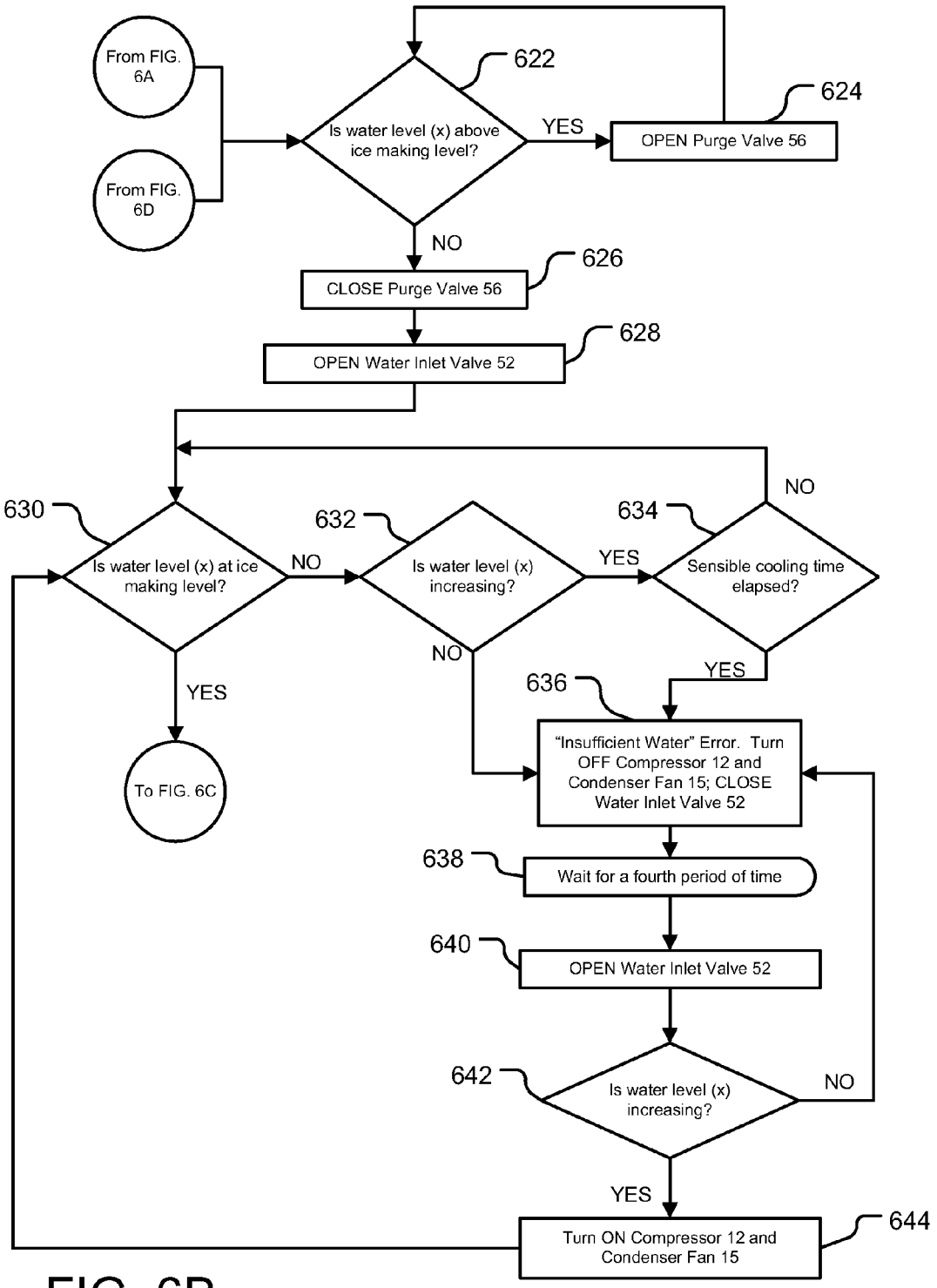
FIG. 6B is flow chart describing the operation of an ice maker according to one embodiment of the invention.

When the method continues on to FIG. 6B, compressor 12 is ON, condenser fan 15 is ON, hot gas valve 24 is CLOSED, and water pump 62 is ON. Accordingly, the refrigeration and water systems of ice maker 10 are operating and are beginning to cool any water that circulates over freeze plate 60. At step 622, controller 80 via air pressure sensor 84 measures the water level (x) in sump 70 to determine whether the water level (x) is above the ice making level. The ice making level may be the nominal level of water that is used to produce a desired thickness of ice. If the water level (x) is above the ice making level, controller 80 OPENS purge valve 56 to remove any excess water from sump 70 at step 624. If the water level (x) in sump 70 is at the ice making level, controller 80 CLOSES purge valve 56 at step 626. Then at step 628 controller 80 OPENS water inlet valve 52 to begin filling up sump 70 with water to be frozen into ice by ice maker 10.

At step 630, controller 80 via air pressure sensor 84 measures the water level (x) in sump 70 to determine whether the water level (x) in sump 70 is at the ice making level. If the water level (x) of sump 70 is at the ice making level, the method moves to step 646 on FIG. 6C. If the water level (x) in sump 70 is not at the ice making level, then at step 632 controller 80 may determine whether the water level (x) in sump 70 is increasing. If the water level (x) in sump 70 is not increasing, a failure mode of the water supply has likely occurred. This failure mode may be an insufficient amount of water has been supplied to sump 70. Accordingly, at step 636 controller 80 turns OFF compressor 12, turns OFF condenser fan 15, and CLOSES water inlet valve 52. At step 638, controller 80 waits for a fourth period of time. In certain embodiments, for example, the fourth period of time may be from about 10 seconds to about 1.5 minutes (e.g., about 10 seconds, about 20 seconds, about 30 seconds, about 40 seconds, about 50 seconds, about 1 minute, about 1.5 minutes).

After the fourth period of time has elapsed, controller 80 OPENS water inlet valve 52 at step 640. Then at step 642, controller 80 again determines whether the water level (x) in sump 70 is increasing. If the water level (x) is not increasing, the method returns to step 636 and controller 80 turns OFF compressor 12, turns OFF condenser fan 15, and CLOSES water inlet valve 52. Optionally, controller 80 may be able to log, report and/or indicate an "Insufficient Water" failure mode. In certain embodiments, display 104 and/or the alarm may indicate that such a failure mode has been detected. For example, the indication may be a message, an indicator light, and/or a sound specific to the detected failure mode. By delaying for a period of time, controller 80 can wait for any turbulent and/or transient movement of water in sump 70 to cease and can check to ensure that sump 70 has water. If at step 642 the water level (x) in sump 70 is increasing, controller 80 turns ON compressor 12 and turns ON condenser fan 15 at step 644 then proceeds to step 630 to check whether the water level (x) in sump 70 is at the ice making level. If the water level (x) in sump 70 is at the ice making level, the method moves to step 646 on FIG. 6C.

If back at step 632 the water level (x) in sump 70 is increasing, controller 80 may determine whether the sensible cooling cycle time has elapsed. By checking to see if the sensible cooling time has elapsed, controller 80 can determine if the flow rate of the water through water inlet valve 52 is insufficient and/or too slow. An insufficient and/or too slow water inlet flow rate may be caused by a variety of factors including, but not limited to, a loss of water pressure, an obstruction, a partially open purge valve 56, etc. Accordingly, ice maker 10 may not be able to properly make ice if sump 70 is still being filled to the ice making level after the sensible cooling cycle time has elapsed. Instead, it is desired that the water level (x) in sump 70 be at the ice making level prior to entering the latent cooling cycle. In certain embodiments, for example, the sensible cooling cycle time may be from about 1 minute to about 15 minutes (e.g., about 1 minute, about 1.5 minutes, about 2 minutes, about 2.5 minutes, about 3 minutes, about 3.5 minutes, about 4 minutes, about 4.5 minutes, about 5 minutes, about 5.5 minutes, about 6 minutes, about 6.5 minutes, about 7 minutes, about 7.5 minutes, about 8 minutes, about 8.5 minutes, about 9 minutes, about 9.5 minutes, about 10 minutes, about 10.5 minutes, about 11 minutes, about 11.5 minutes, about 12 minutes, about 12.5 minutes, about 13 minutes, about 13.5 minutes, about 14 minutes, about 14.5 minutes, about 15 minutes). If the sensible cooling cycle time has not yet elapsed, the method cycles back to step 630. If the sensible cooling cycle time has elapsed, the method cycles to step 636 as described above. Accordingly, step 632 and step 634 provide for detecting insufficient water. In certain embodiments, for example, controller 80 may skip step 632 and proceed from step 630 to step 634 without determining whether the water level (x) in sump 70 is increasing.

Figure 6C:
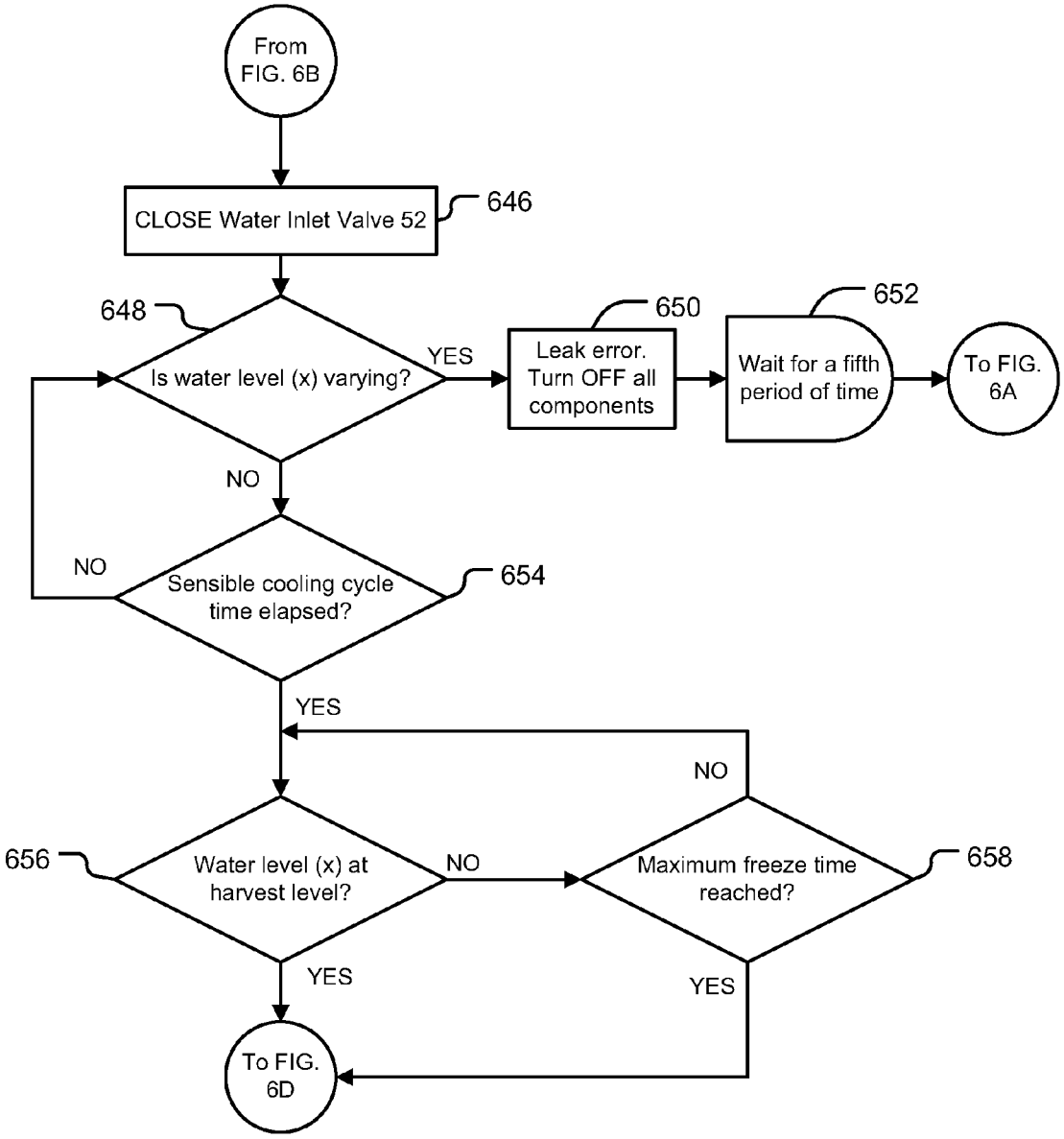
FIG. 6C is flow chart describing the operation of an ice maker according to one embodiment of the invention.

When the method continues on to FIG. 6C, compressor 12 is ON, condenser fan 15 is ON, hot gas valve 24 is CLOSED, and water pump 62 is ON. Accordingly, the refrigeration and water systems of ice maker 10 are operating and are beginning to cool any water that circulates over freeze plate 60. At step 646, because the water level (x) in sump is at the ice making level (step 630 on FIG. 6B), controller 80 CLOSES water inlet valve 52. At step 648, controller 80 via air pressure sensor 84 measures the water level (x) in sump 70 to determine whether the water level (x) is varying beyond an acceptable range of the ice making level. In certain embodiments, the acceptable range may be from about +/−1 percent of the ice making level to about +/−25 percent of the ice making level. In one embodiment, for example, the acceptable range may be about +/−1 percent of the ice making level. In another embodiment, for example, the acceptable range may be about +/−5 percent of the ice making level. In yet another embodiment, for example, the acceptable range may be about +/−10 percent of the ice making level. In yet another embodiment, for example, the acceptable range may be about +/−15 percent of the ice making level. In yet another embodiment, for example, the acceptable range may be about +/−20 percent of the ice making level. In yet another embodiment, for example, the acceptable range may be about +/−25 percent of the ice making level. At this time during the sensible cooling cycle, the water that is supplied by water pump 62 cools as it contacts freeze plate 60, returns to water sump 70 below freeze plate 60 and is recirculated by water pump 62 to freeze plate 60. During sensible cooling, the water level (x) in sump 70 should not be decreasing as the water is only decreasing in temperature but is not yet freezing into ice on freeze plate 60.

Accordingly, if the water level (x) is varying from the ice making level beyond an acceptable range, there may be a leak in sump 70, and/or water inlet valve 24 or purge valve 52 may be leaking. At step 650 controller 80 turns OFF all components of the refrigeration and water systems of ice maker 10. Optionally, controller 80 may be able to log, report and/or indicate a leak failure mode. In certain embodiments, display 104 and/or the alarm may indicate that such a failure mode has been detected. For example, the indication may be a message, an indicator light, and/or a sound specific to the detected failure mode. At step 652, controller 80 waits for a fifth period of time. In certain embodiments, for example, the fifth period of time may be from about 1 minute to about 7 minutes (e.g., about 1 minute, about 1.5 minutes, about 2 minutes, about 2.5 minutes, about 3 minutes, about 3.5 minutes, about 4 minutes, about 4.5 minutes, about 5 minutes, about 5.5 minutes, about 6 minutes, about 6.5 minutes). After the fifth period of time has elapsed, the method moves to step 600 on FIG. 6A.

If at step 648 controller 80 determines that the water level (x) is not varying beyond an acceptable range, controller 80 checks during step 654 whether the sensible cooling cycle time has elapsed. Sensible cooling cycle time may be from about 1 minute to about 15 minutes (e.g., about 1 minute, about 1.5 minutes, about 2 minutes, about 2.5 minutes, about 3 minutes, about 3.5 minutes, about 4 minutes, about 4.5 minutes, about 5 minutes, about 5.5 minutes, about 6 minutes, about 6.5 minutes, about 7 minutes, about 7.5 minutes, about 8 minutes, about 8.5 minutes, about 9 minutes, about 9.5 minutes, about 10 minutes, about 10.5 minutes, about 11 minutes, about 11.5 minutes, about 12 minutes, about 12.5 minutes, about 13 minutes, about 13.5 minutes, about 14 minutes, about 14.5 minutes, about 15 minutes). If the sensible cooling cycle time has not yet elapsed, the method cycles back to step 648. After the sensible cooling cycle time has elapsed, the ice maker enters the latent cooling cycle. During the latent cooling cycle, water that collects in freeze plate 60 starts forming ice and the water level (x) in sump 70 begins to decrease. Accordingly, the water level (x) in sump 70 will continue to drop as the thickness of ice forming in freeze plate 60 increases.

At step 656 controller 80 via air pressure sensor 84 measures the water level (x) in sump 70 to determine whether the water level (x) in sump 70 has reached the desired harvest level. The desired harvest level may correspond to a desired ice thickness. Thus when controller 80 via air pressure sensor 84 measures that the water level (x) in sump 70 is at the harvest level, the desired thickness of ice in freeze plate 60 has been reached and the harvest cycle can begin. The method thus moves to step 660 on FIG. 6D. If the water level (x) in sump 70 has not reached the harvest level, controller 80 checks during step 658 whether the maximum freeze time has elapsed. In certain embodiments, for example, the maximum freeze time may be from about 30 minutes to about 1.5 hours (e.g., about 30 minutes, about 45 minutes, about 1 hour, about 1.25 hours, about 1.5 hours). In various embodiments, the maximum freeze time may be about 1 hour. If the maximum freeze time has elapsed, the method moves to step 660 on FIG. 6D. Accordingly, in certain embodiments, even if the desired harvest level is not reached, indicating that the desired ice thickness is not reached, ice maker 10 can still harvest the ice after a maximum freeze time has been reached. If the maximum freeze time has not yet elapsed, the method will cycle back to step 656.

Figure 6D:
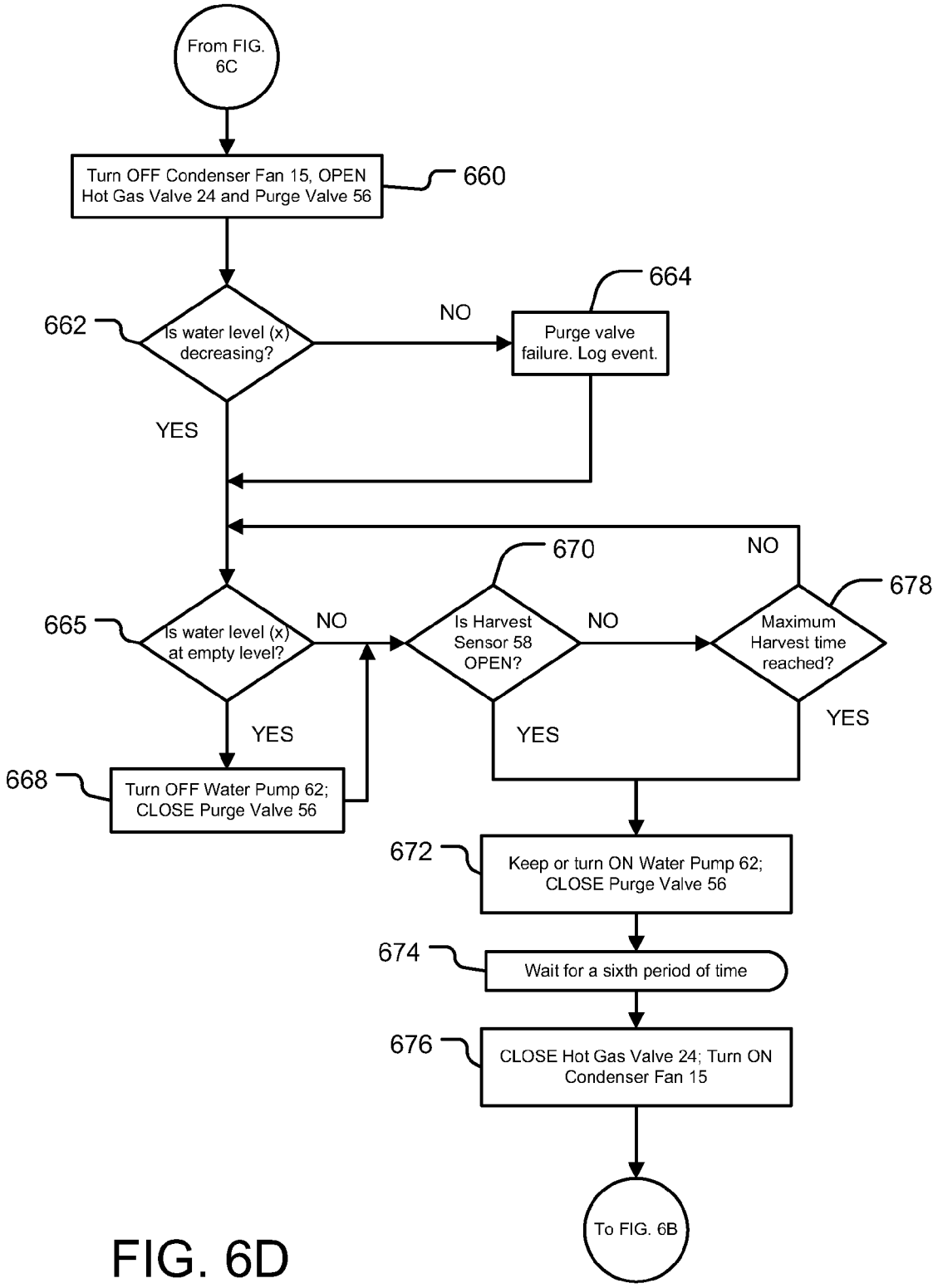
FIG. 6D is flow chart describing the operation of an ice maker according to one embodiment of the invention.

When the method continues on to FIG. 6D, compressor 12 is ON, condenser fan 15 is ON, hot gas valve 24 is CLOSED, and water pump 62 is ON. At step 660 controller 80 turns OFF condenser fan 15, OPENS hot gas valve 24, and OPENS purge valve 56. Opening hot gas valve 24 allows warm, high-pressure gas from compressor 12 to flow through hot gas bypass line 23 to enter evaporator assembly 20. Ice is thereby harvested by warming freeze plate 60 to melt the formed ice to a degree such that the ice may be released from freeze plate 60 and falls through a hole 37 (see FIG. 4) into ice storage bin assembly 30. At step 662, controller 80 via air pressure sensor 84 measures the water level (x) in sump 70 to determine whether the water level (x) in sump 70 is decreasing. If the water level (x) in sump 70 is not decreasing, there may be a purge valve 52 failure and controller 80 may be able to optionally log, report and/or indicate a purge valve 52 failure mode. In certain embodiments, display 104 and/or the alarm may indicate that such a failure mode has been detected. For example, the indication may be a message, an indicator light, and/or a sound specific to the detected failure mode. The method then proceeds to step 665.

If the water level (x) is decreasing, then at step 665, controller 80 via air pressure sensor 84 measures the water level (x) in sump 70 to determine whether the water level (x) in sump 70 has reached the desired empty level. If the water level (x) in sump 70 has reached the empty level, controller 80 turns OFF water pump 62 and CLOSES purge valve 56 at step 668. The method then continues to step 670. However, if at step 665, the water level (x) in sump 70 has not reached the empty level, controller 80 checks during step 670 whether harvest sensor 58 is OPEN. If harvest sensor 58 is OPEN, the method proceeds to step 672 where controller

80 keeps or turns ON water pump 62 and CLOSES purge valve 56. At step 674, controller 80 waits for a sixth period of time, keeping water pump 62 ON. In certain embodiments, for example, the sixth period of time may be from about zero (0) seconds to about 15 seconds (e.g., about zero (0) seconds, about 5 seconds, about 10 seconds, about 15 seconds). Then after the sixth period of time has elapsed, controller 80 turns ON condenser fan 14 and CLOSES hot gas valve 24 at step 676. Accordingly, any water in sump 70 may, in certain embodiments, be circulated over freeze plate 60 prior to the refrigeration system cooling evaporator assembly 20 and freeze plate 60. The method then returns to step 622 on FIG. 6B to start another cooling cycle to make another batch of ice.

However, if at step 670, harvest sensor 58 is CLOSED, controller 80 may check during step 678 whether the maximum harvest time has elapsed. In certain embodiments, for example, the maximum harvest time may be from about 1 minute to about 5 minutes (e.g., about 1 minute, about 1.5 minutes, about 2 minutes, about 2.5 minutes, about 3 minutes, about 3.5 minutes, about 4 minutes, about 4.5 minutes, about 5 minutes). In various embodiments, for example, the maximum harvest time may be about 3.5 minutes. If the maximum freeze time has elapsed, the method proceeds to step 672 as described above.

While various steps are described herein in one order, it will be understood that other embodiments of the method can be carried out in any order and/or without all of the described steps without departing from the scope of the invention.

Thus, there has been shown and described novel methods and apparatuses of an ice maker having a controller adapted to measure the water level in a sump and to detect various failure modes, which overcome many of the problems of the prior art set forth above. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

The invention claimed is:

1. An ice maker for forming ice using a refrigerant capable of transitioning between liquid and gaseous states, the ice maker comprising:

(i) a refrigeration system comprising a compressor, a condenser, a thermal expansion device, an evaporator assembly, a freeze plate thermally coupled to the evaporator assembly, and a hot gas valve;

(ii) a water system comprising a water pump, a water distribution tube, a purge valve, a water inlet valve, and a sump located below the freeze plate adapted to hold water; and (iii) a control system comprising:

(a) an air fitting disposed in the sump defining a chamber in which air may be trapped and wherein the air fitting comprises one or more openings through which water in the sump is in fluid communication with the air in the chamber;

(b) a pneumatic tube having a proximal end and a distal end, wherein the distal end is connected to and in fluid communication with the air fitting; and (c) a controller comprising a processor and an air pressure sensor, wherein the proximal end of the pneumatic tube is connected to and in fluid communication with the air pressure sensor and wherein the air pressure sensor is adapted to sense an air pressure from the water in the sump compressing the air in the chamber of the air fitting, wherein the sensed air pressure corresponds to a water level in the sump and wherein the controller is adapted to control the operation of the refrigeration system and the operation of the water system based upon the water level in the sump and to detect one or more failure modes of the water system based upon the water level in the sump, wherein the controller is adapted to detect a leak failure mode when the water level in the sump varies beyond an acceptable range during a sensible cooling cycle, wherein if the water level in the sump decreases during a latent cooling cycle a leak failure mode is not detected.

2. The ice maker of claim 1 wherein the controller is adapted to detect a water pump failure mode when the water level in the sump does not decrease when the water pump is turned on.

3. The ice maker of claim 1 wherein the controller is adapted to detect an insufficient water failure mode when the water level in the sump does not increase when the water inlet valve is turned on.

4. The ice maker of claim 1 wherein the controller is adapted to detect a purge valve failure mode when the water level in the sump does not decrease when the purge valve is turned on.

5. The ice maker of claim 1 wherein when the controller detects a failure mode, the ice maker is adapted to indicate that the failure mode has been detected.

6. A method of controlling an ice maker, the ice maker comprising (i) a refrigeration system comprising a compressor, a condenser, a thermal expansion device, an evaporator assembly, a freeze plate thermally coupled to the evaporator assembly, and a hot gas valve, (ii) a water system comprising a water pump, a water distribution tube, a purge valve, a water inlet valve, and a sump located below the freeze plate adapted to hold water, and (iii) a control system comprising (a) an air fitting disposed in the sump defining a chamber in which air may be trapped and wherein the air fitting comprises one or more openings through which water in the sump is in fluid communication with the air in the chamber, (b) a pneumatic tube having a proximal end and a distal end, wherein the distal end is connected to and in fluid communication with the air fitting, and (c) a controller comprising a processor and an air pressure sensor, wherein the proximal end of the pneumatic tube is connected to and in fluid communication with the air pressure sensor and wherein the air pressure sensor is adapted to sense an air pressure from the water in the sump compressing the air in the chamber of the air fitting, wherein the sensed air pressure corresponds to a water level in the sump, the method comprising:

measuring the water level in the sump during a sensible cooling cycle to determine if the water level is varying beyond an acceptable range;

detecting a leak failure mode if the water level in sump varies beyond the acceptable range during the sensible cooling cycle, wherein if the water level in the sump decreases during a latent cooling cycle a leak failure mode is not detected.

7. The method of claim 6 further comprises indicating the leak failure mode if the leak failure mode is detected.

8. The method of claim 6 further comprising:

turning the water pump on;

measuring the water level in the sump to determine if the water level is decreasing;

detecting a water pump failure mode if the water level in sump does not decrease when the water pump is on.

9. The method of claim 8 wherein the method further comprises indicating the water pump failure mode if the water pump failure mode is detected.

10. The method of claim 8 further comprising:

turning off the refrigeration and water systems;

waiting for a period of time;

turning on the water pump;

measuring the water level in the sump to determine if the water level is decreasing; and turning on the compressor and the condenser fan if the water level in sump decreases when the water pump is on.

11. The method of claim 10 further comprising repeating the steps of claim 10 if the water level in sump does not decrease when the water pump is on.

12. The method of claim 6 further comprising:

opening the water inlet valve;

measuring the water level in the sump to determine if the water level has reached an ice making level before a sensible cooling time has elapsed;

detecting an insufficient water failure mode if the water level in sump has not reached the ice making level before the sensible cooling time has elapsed.

13. The method of claim 12 wherein the method further comprises indicating the insufficient water failure mode if the insufficient water failure mode is detected.

14. The method of claim 12 further comprising:

turning off the compressor and the condenser fan and closing the water inlet valve;

waiting for a period of time;

opening the water inlet valve;

measuring the water level in the sump to determine if the water level is increasing; and turning on the compressor and the condenser fan if the water level in sump increases when the water inlet valve is open.

15. The method of claim 14 further comprising repeating the steps of claim 14 if the water level in sump does not increase when the water inlet valve is open.

16. The method of claim 6 further comprising:

measuring the water level in the sump after the sensible cooling cycle has elapsed to determine if the water level is at the harvest level;

turning off the condenser fan, opening the hot gas valve, and opening the purge valve;

measuring the water level in the sump to determine if the water level is decreasing;

detecting a purge valve failure mode if the water level in sump does not decrease when the purge valve is open.

17. The method of claim 16 wherein the method further comprises indicating the purge valve failure mode if the purge valve failure mode is detected.

18. The method of claim 6 further comprising:

turning off the condenser fan, opening the hot gas valve, and opening the purge valve after the expiration of a maximum freeze time;

measuring the water level in the sump to determine if the water level is decreasing;

detecting a purge valve failure mode if the water level in sump does not decrease when the purge valve is open.

19. The method of claim 18 wherein the method further comprises indicating the purge valve failure mode if the purge valve failure mode is detected.

* * * * *